United States Patent [19]

Drappel et al.

[11] Patent Number: 5,023,160

[45] Date of Patent: Jun. 11, 1991

[54] LIQUID DEVELOPER COMPOSITIONS

[75] Inventors: Stephan Drappel; James D. Mayo, both of Toronto; Melvin D. Croucher, Oakville, all of Canada

[73] Assignee: Xerox Corporation, Stamford, Conn.

[21] Appl. No.: 433,309

[22] Filed: Nov. 8, 1989

[51] Int. Cl.[5] ..... G03G 9/00

[52] U.S. Cl. ..... 430/114; 430/115

[58] Field of Search ..... 430/114, 115

[56] References Cited

U.S. PATENT DOCUMENTS

| | | | |
|---|---|---|---|
| 3,272,644 | 9/1966 | Nelson | 117/17.5 |
| 3,296,140 | 1/1967 | Zubiak | 252/62.1 |
| 3,301,698 | 1/1967 | Fauser et al. | 117/37 |
| 3,692,520 | 9/1972 | Mammino et al. | 96/1.3 |
| 3,743,503 | 7/1973 | Goldman et al. | 96/1 |
| 3,781,208 | 12/1973 | Ueda et al. | 252/62.1 |
| 3,849,165 | 11/1974 | Stahly et al. | 117/37 LE |
| 4,059,444 | 11/1977 | Lu et al. | 96/1 LY |
| 4,264,699 | 4/1981 | Tsubuko et al. | 430/112 |
| 4,384,036 | 5/1983 | Sasaki | 430/113 |
| 4,476,210 | 10/1984 | Croucher et al. | 430/114 |
| 4,636,452 | 1/1987 | Furukawa et al. | 430/112 |
| 4,816,370 | 3/1989 | Croucher et al. | 430/115 |
| 4,830,945 | 5/1989 | Wong et al. | 430/114 |
| 4,842,975 | 6/1989 | Kato et al. | 430/114 X |
| 4,877,698 | 10/1989 | Watson et al. | 430/45 |
| 4,880,432 | 11/1989 | Egan et al. | 430/115 X |

*Primary Examiner*—Marion E. McCamish
*Assistant Examiner*—S. Crossan
*Attorney, Agent, or Firm*—E. O. Palazzo

[57] ABSTRACT

A liquid developer composition comprised of aliphatic hydrocarbon insoluble polyolefin resin particles, a hydrocarbon carrier liquid, dye or dyes which are soluble in the resin, and insoluble in the liquid, and a charge director.

21 Claims, No Drawings

LIQUID DEVELOPER COMPOSITIONS

BACKGROUND OF THE INVENTION

This invention is directed to developer compositions and more specifically to liquid developer compositions containing dyes. In one embodiment, the present invention is directed to liquid developer compositions comprised of resin particles, olefin soluble dyes, preferably dyes that are soluble in the resin and insoluble in the selected carrier liquid, such as Isopar. Also, the present invention is directed to postively charged or negative charged liquid inks where charge directors such as barium petronates, lecithin and the like are selected to permit negatively charged inks, and charge directing components, such as zirconium octoate, iron naphthenate, and a polyisobutylene based polyester are selected to permit positively charged inks. The economical liquid inks of the present invention can be selected for the development of images in various imaging processes, including the liquid developer processes described in U.S. Pat. No. 3,084,043, the disclosure of which is totally incorporated herein by reference; xerographic processes, electrographic recording, electrostatic printing, and facsimile systems; color proofing processes; and the process as illustrated in British Patent Publication 2,169,416, published July 9, 1986, and U.S. Pat. No. 4,794,651, the disclosures of which are totally incorporated herein by reference.

Development of electrostatic latent images with liquid developer compositions comprised of, for example, a dispersion of pigments in a liquid hydrocarbon is known. In these methods, the electrostatic latent image, which is usually formulated on a single sheet of photoconductive paper, such as zinc oxide, is transported through a bath of the aforementioned liquid developer. Contact with the liquid developer causes the charged pigment particles present therein to migrate through the liquid to the zinc oxide sheet in the configuration of a charged image. Thereafter, the sheet is withdrawn from the liquid developer bath with the charged pigment particles adhering to the electrostatic latent image in image configuration. The thin film of residual developer remaining on the surface of the sheet is then evaporated within a relatively short time period, usually less than 5 seconds. Also, the marking pigment particles may be fixed to the sheet by heat, for example, in image configuration.

In a patentability search report, the following prior art was recited, all U.S. Pat. Nos. 3,743,503 directed to liquid developers comprised of an electrically insulating organic carrier liquid having dispersed therein marking particles comprised of polymeric dye having a linear backbone chain to which are attached pendant side chains containing a chromophoric moiety, reference the Abstract of the Disclosure, for example; 4,384,036 which describes a process for preparing a liquid developer wherein fine polymer particles are dispersed in a nonpolar solvent mixed with a dye that is insoluble in the nonpolar solvent in which is soluble in the monomer which is at least one component of the polymer, and thereafter the polymer particles are colored by removing from the dispersion a second solvent which dissolves the dye and which is apparently capable of swelling at least part of the polymer, reference the Abstract of the Disclosure; 4,476,210, mentioned herein, which illustrates a stable liquid developer with colored dyes being imbibed into a thermoplastic resin core, reference the Abstract of the Disclosure, for example; 4,636,452 directed to a method for preparing a resin dispersion containing resin particles dispersed in a high insulating hydrocarbon medium, which comprises a first polymer dissolved in the medium in which liquid toner may contain colorant such as dyes, reference column 5, beginning at line 25; 3,272,644 directed to development of latent images with crystalline toners wherein there is dispersed a dye in a crystalline carrier material, and wherein liquid developers are disclosed with such materials, see column 2, beginning at line 21; and as collateral or background interest, some of which teach the use of dyes and liquid developers, 3,296,140; 3,301,698; 3,692,520; 3,781,208; 3,849,165; 4,059,444 and 4,264,699.

There are disclosed in U.S. Pat. No. 3,554,946 liquid developers for electrophotography comprised of a carrier liquid consisting of a hydrocarbon, negatively electrostatically charged toner particles dispersed in the carrier liquid, and a pigment therein such as carbon black, aniline black, prussian blue, phthalocyanine red, and cadmium yellow. In accordance with the teachings of this patent, a copolymer is coated on the surface of the pigment particles for the primary purpose of imparting a negative electrostatic charge to these particles. Other patents disclosing similar liquid developer compositions include U.S. Pat. Nos. 3,623,986; 3,625,897; 3,976,583; 4,081,391 and 3,900,412. In the '412 there is specifically disclosed a stable developer comprised of a polymer core with a steric barrier attached to the surface of the polymer selected. In column 15 of this patent, there are disclosed specfic colored liquid developers. Attempts to obtain useful color liquid developer compositions by the ball milling process described in the '412 patent have been substantially ineffective, particularly with respect to obtaining developed images of acceptable optical density in that, for example, the desired size for the latex particles is from 0.2 to 0.3 micron in diameter; and with ball milling techniques, it is very difficult to provide a dispersion of carbon black or other pigment particles much smaller in size than about 0.7 to about 0.8 micron.

Additionally, there are described in U.S. Pat. No. 4,476,210, the disclosure of which is totally incorporated herein by reference, liquid developers containing an insulating liquid dispersion medium with submicron size marking particles therein, which particles are comprised of a thermoplastic resin core substantially insoluble in the dispersion, an amphipathic block or graft copolymeric stabilizer irreversibly chemically or physically anchored to the thermoplastic resin core, and a colored dye imbibed in the thermoplastic resin core. There is also illustrated in this patent the use of zirconium octoate as a positive charge control agent with a vinyl resin and Isopar®. The history and evolution of liquid developers is provided in the '210 patent, reference columns 1 and 2 thereof.

Also of interest are U.S. Pat. Nos. 3,869,397, which discloses the use of zirconium octoate as a negative charge control agent for a carbon black pigment in a vinyl resin, and 3,939,087, which illustrates for example a liquid developer comprising a pigment, and dye and polymer with zirconium octoate in Ispoar®, which octoate can apparently function as a charge director.

In addition, there are illustrated in the aforementioned British Patent Publication 2,169,416, and U.S. Pat. No. 4,794,651 liquid developer compositions comprising toner particles associated with a pigment dispersed in a nonpolar liquid, and wherein the toner particles are formulated with a plurality of fibers or tendrils from a thermoplastic polymer, and carry a charge of polarity opposite to the polarity of the latent image. These toners apparently permit, in some instances, excellent transfer efficiencies, and exhibit excellent copy quality.

There is illustrated in Japanese Laid Open as Kokai 238581/87 on Oct. 19, 1987, the disclosure of which is totally incorporated herein by reference, stable black submicron liquid developer comprised of an insulating liquid medium having dispersed therein black marking particles comprised of a thermoplastic resin core, which is substantially insoluble in the dispersion medium, and chemically or physically anchored to the resin core an amphipathic block or graft copolymer steric stabilizer, which is soluble in the dispersion medium; and wherein dyes comprised of a specific mixture are imbibed in the thermoplastic resin core with the mixture of dyes being dispersible at the molecular level, and therefore soluble in the thermoplastic resin core and insoluble in the dispersion medium.

Other U.S. patents of interest include U.S. Pat. No. 4,210,805, which discloses toner particles prepared by adding a solvent solution of polyvinylcarbazole to Isopar® wherein the diameter of the particles is a function of the ratio of solvent to Isopar®, reference column 8; U.S. Pat. No. 4,032,463 which illustrates that the ratio of toluene to Isopar® effects toner resin particle size; and U.S. Pat. No. 3,766,072 which appears to disclose that resin solvency in the vehicle effects the particle size. Also, in the '463 and '072 patents it is indicated that a solvency increase of the dispersion medium provides a larger final size particle. This occurs, it is believed, because one of the liquids used in formulating such developers is a solvent for the resin that is used. Consequently, the particle will be swollen by the entrapped solvent in the particle yielding a larger particle size. Also, in the polymerization process changing the solvent/nonsolvent ratio of the dispersion medium changes the kinetics and thus the mechanism by which particles are formed. With latex particle polymerization in hydrocarbon media, usually only submicron size particles are envisioned, reference for example "Dispersion Polymerization in Organic Media", ed. K. E. J. Barrett, Academic Press, 1975. However, it has recently been disclosed, reference M. A. Winnik, R. Lukas, W. F. Chen, P. Furlong, and M. D. Croucher, *Makromol. Chem.*, Makromol. Symp. 10/11, 488, (1987), that by varying the solvent/nonsolvent ratio of the dispersion medium for the polymer particle being formed that the particle size may be altered and particles up to 15 microns diameter may be formed. The advantage of this technique for liquid developers has been described in U.S. Pat. No. 4,789,616, the disclosure of which is totally incorporated herein by reference.

Although the above described liquid inks are suitable in most instances for their intended purposes, there remains a need for other liquid developers, including inks which can be positively charged enabling their utilization, for example, with layered imaging members which are negatively charged, reference U.S. Pat. No. 4,265,990, the disclosure of which is totally incorporated herein by reference. There is also a need for negatively charged inks which can be selected for imaging and printing processes wherein inorganic imaging members including chalcogenides, such as selenium, selenium alloys, doped selenium substances, and doped selenium alloys, including specifically selenium arsenic, selenium tellurium, selenium tellurium arsenic, and the like optionally doped with from, for example, about 200 to about 500 parts of a halogen such as chlorine can be selected. Additionally, there is a need for liquid inks containing dyes soluble in the resin binder and insoluble in the carrier component, such as Isopar®. Furthermore, there is a need for liquid ink compositions with transfer efficiencies from imaging members to paper of greater than 95 percent and which possess reflection optical densities between about 1.1 and about 1.4 for black solid areas, and between about 0.9 and about 1.2 for colored images. Additionally, there is a need for liquid developer compositions that can be selected for a number of imaging processes including those illustrated in U.S. Pat. Nos. 3,084,043; 4,794,651, and British Publication 2,169,416 (corresponds to the aforementioned '651 patent), the disclosures of which are totally incorporated herein by reference. One main advantage associated with the liquid compositions of the present invention resides in the dye being molecularly dispersed in the resin selected rather than existing in clumps of aggregated molecules as is the situation when pigments are utilized rather than dyes. Another advantage associated with liquid developers containing dyes resides in the formation of brighter clearer colors on paper. These developer compositions wherein the dyes are, for example, molecularly dispersed in a resin can also be selected for the generation of excellent colored images on transparencies. Moreover, color mixing of the different dye based inks of the present invention are more easily achieved as compared to pigment based inks. In an embodiment of the present invention, dyes compatible with the resin can be selected as contrasted to inks with pigments wherein substantially any pigment may be selected, some of which are not compatible with the resin. There is also a need for ink compositions wherein a common charge director can be utilized with different colored dyes primarily since the toner resin is believed to be the dominant factor in controlling the charging properties. Also, with common charge directors economical advantages are achievable.

Another specific need resides in the provision of economical, excellent light fastness liquid developers with olefin soluble dyes as colorants rather than pigments wherein the aforementioned colorant is molecularly dispersed in the resin rather than existing in clumps of aggregated molecules.

SUMMARY OF THE INVENTION

It is the object of the present invention to provide liquid developer compositions with many of the advantages illustrated herein.

In another object of the present invention there are provided positively or negatively charged liquid developer compositions containing dyes.

Yet another object of the present invention is to provide liquid developer compositions with transfer efficiencies exceeding 85 percent, and in some instances 99 percent.

Furthermore, another object of the present invention is directed to liquid developer compositions comprised of polyolefin based resins, such as Elvax II 5720, commercially available from E.I. Dupont Company, dyes such as the Orasol series of dyes available from Ciba-Geigy and the like, which are soluble in the resin, and charge directors such as lecithin, barium petronate, zirconium octoate, iron naphthenate, or polyisobutylene succinimide.

Additionally, in another object of the present invention there are provided liquid developer compositions comprised of olefin soluble dyes as colorants rather than pigments and wherein the colorant is molecularly dispersed in the resin rather than existing in clumps of aggregated molecules.

Also, in another object of the present invention there are provided liquid developer compositions comprised of aliphatic hydrocarbon insoluble polyolefin resin particles, hydrocarbon carrier liquids, dye or dyes which are soluble in the resin, and insoluble in the carrier liquid and a charge director, which liquid developers possess a number of advantages including permitting excellent image resolution, bright color resolution, excellent lightfastness characteristics, and other advantages as illustrated herein.

Moreover, in another object of the present invention there are provided liquid ink compositions useful in various development systems inclusive of electrostatic, printing, color proofing methods, and the like.

These and other objects of the present invention are accomplished by providing liquid developer compositions. More specifically, in one embodiment the present invention is directed to liquid ink compositions comprised of resin particles, dyes, and charge directors wherein the dyes are soluble in the resin and insoluble in the carrier component such as Isopar. In one specific embodiment of the present invention, the liquid inks are comprised of resin particles, such as Elvax II 5720, a hydrocarbon such as petroleum distillates inclusive of the Isopars ®, or mixtures thereof, dyes which are soluble in the resin and a charge director or charge control additive.

Another embodiment of the present invention is directed to a liquid developer composition comprised of aliphatic hydrocarbon insoluble polyolefin resin particles, a hydrocarbon carrier liquid, a dye or mixture of dyes, which are soluble in the resin and insoluble in the hydrocarbon carrier liquid, and a charge director.

Illustrative examples of polymer resin components, which components are substantially insoluble, or insoluble in the carrier vehicle, or similar vehicle at, for example, room temperature and elevated temperatures up to, for example 130° C., include the Elvaxes, such as Elvax II resins, which are mainly polyethylenes that have been copolymerized with an acid, such as methacrylic acid, and the like. The resin is present in the ink in an effective amount of, for example, from about 0.5 percent to 6 percent by weight, and preferably from about 0.75 to 4 percent by weight. Examples of dyes include Orasol Blue GN, Orasol Red 2BL, Orasol Blue BLN, Orasol Black CN, Orasol Yellow 2RLN, Orasol Red 2B, Orasol Blue 2GLN, Orasol Yellow2GLN, Orasol Red G, Orasol Black RL, all available from Ciba Geigy of Ontario Canada; Morfast Blue 100, Morfast Red 101, Morfast Red 104, Morfast Yellow 102, Morfast Black 101, all available from Morton Chemicals Ltd.; Ajax Ontario Canada; Savinyl Yellow RLS, Savinyl Pink 6BLS, Savinyl Red 3BLS, Savinyl Red GL, Savinyl Black RLS, all available from Sandoz of Canada; Neozapon Black X57 available from BASF of Canada, and the like. Other dyes can be selected, especially those that are soluble in alcohols such as methanol, ethanol, and the like, but are insoluble in hydrocarbons, such as Isopars ®. Also, water insolubility of the dye assists in providing permanence of the developed image, which is not the situation with many prior art developers wherein the image would dissolve when it contacts water, or staples containing water such as coffee, tea, and the like. The dyes are preferably present in the resin in an amount of from about 1 to about 25 percent by weight, and preferably of from about 3 to about 18 percent by weight.

The ink dispersion media or hydrocarbon carrier liquid can be comprised of petroleum distillates which are commercially available as Isopar ®, inclusive of Isopar ® G, H, L and M, mixtures thereof, and the like. Other components suitable for the liquid or carrier vehicle include high purity aliphatic hydrocarbons with, for example, from 1 to about 25 carbon atom,s and preferably with a viscosity of less than 3 centipose, such as Norpar ® 12, Norpar ® 13 and Norpar ® 15, available from Exxon Corporation; Amsco ® 460 Solvent, Amsco ® OMS, available from American Mineral Spirits Company; Soltrol ®, available from Phillips Petroleum Company; Pagasol ®, available from Mobil Oil Corporation; Shellsol ®, available from Shell Oil Company, and the like. Particularly preferred liquid vehicles include Isopar ® G, Isopar ® H, and Isopar ® L. Generally, the carrier liquid is present in the ink in an effective amount of from, for example, about 90 to 99.5 weight percent, and preferably in an amount of from about 96 to about 99.25 weight percent.

Examples of charge control additives that may be selected for the liquid developer compositions of the present invention, and that are present in an effective amount of, for example, from about 0.01 percent by weight to about 2.0 percent by weight, and preferably in an amount of from about 0.02 percent by weight to about 0.2 percent by weight, are as illustrated herein and include zirconium octoate, iron naphthenate, a polyisobutylene based polyester, and the like. Mixtures of these materials may also be used. Preferred charge control directors are zirconium octoate, which is available from Nuodex Canada, a polyisobutylene succinimide commercially available as OLOA 1200 from Chevron Chemical Company, and iron napthenate commercially available from Nuodex Canada.

The liquid developers described herein can be prepared by a number of methods including the mixing of resin, such as Elvax II 5720 available from E.I. DuPont Company, with dye to achieve solubilization of the dye in the resin. More specifically, in one embodiment the resin is heated to an effective temperature of, for example, from about 100 to about 130° C., and preferably about 115° C., in a Union Process 01 attritor thereby permitting the resin to melt and become fluid. An about 5 to about 20, and preferably a 10 wt/vol%, solution of the dye in methanol is then mixed into the aforementioned melted resin and the dye solution becomes imbibed therein forming a one phase mixture. Evaporation of the alcohol can be accomplished at 115° C. in the attritor, which temperature is greater than the boiling pint of the alcohol, thereby resulting in a molten dyed resin solution. Generally, the dye is present in the resin in various effective amounts, for example, from about 3 to about 25, and preferably from about 6 to about 20 weight percent. Thereafter, to the prepared dye/resin solution, which is maintained, for example, at 115° C., there is added a hydrocarbon carrier liquid, such as Isopar, especially Isopar ® L, enabling the formation of a dyed resin/hydrocarbon mixture wherein the hydrocarbon functions primarily as a diluent for the dyed resin and lowers its viscosity. The hydrocarbon is selected in various effective amounts such as, for example, from about 80 to about 96, and preferably from about 82 to about 94 weight percent. Subsequently, the resulting mixture is cooled to ambient temperature, about 25° C. in this embodiment, under constant attrition for a period of, for example, from about 1 to about 6 hours, permitting particles with an average diameter of from about 2 to about 10, and preferably from about 2 to about 5 microns as determined by a Horiba Centrifugal Analyzer. The aforementioned resulting dispersion is then further diluted with Isopar® to provide a dispersion containing between 0.75 and 6 weight percent of solids and preferably 1 weight percent of solids. A charge control component is then added to the formed dispersion to enable an electrophoretic liquid developer with a charge/mass ratio, for example, of from about 70 to about 130 $\mu C\ g^{-1}$ and preferably from about 90 to 120 $\mu C\ g^{-1}$ in an embodiment of the present invention.

The charge director as indicated herein is present in an amount of from, for example, about 0.01 percent by weight to about 2 percent by weight, and preferably is present in an amount of from about 0.02 percent by weight to about 0.2 percent by weight. A preferred charge control additive director is zirconium octoate available from Nuodex Canada. The charge directors impart a positive or negative charge to the toner composition as indicated herein, which charge is dependent primarily on the interaction of the molecularly dissolved charge additive with the surface of the composite resin/dye particle. Charge directors such as lecithin, available from Fisher Scientic, basic barium petronate, polyisobutylene succinimide available as OLOA 1200, and the like, can be selected to impart a negative charge to the liquid toners of the present invention.

The ink compositions of the present invention are particularly useful in liquid development systems, such as those illustrated in the aforementioned British Patent Publication and U.S. Pat. No. 4,794,651, and color proofing processes. More specifically, these processes involve depositing an electrostatic charge pattern on a photoreceptor or a dielectric surface, and then toning electrostatic image with the liquid developer of the present invention, followed by electrostatically transferring to plain paper. In addition, the liquid developer compositions of the present invention are also useful for enabling the development of colored electrostatic latent images, particularly those contained on an imaging member charged positively or negatively. Examples of imaging members that may be selected include various known organic photoreceptors, including layered photoreceptors. Illustrative examples of layered photoresponsive devices include those with a substrate, a photogenerating layer, and a transport layer as disclosed in U.S. Pat. No. 4,265,990, the disclosure of which is totally incorporated herein by reference. Examples of photogenerating layer pigments are trigonal selenium, metal phthalocyanines, metal free phthalocyanines, and vanadyl phthalocyanine. Transport material examples include various diamines dispersed in resinous binders. Other imaging members that can be selected are ionographic surfaces of various dielectric materials, such as polycarbonate polysulfone fluoropolymers, and anodized aluminum alone or filled with wax expanded fluoropolymers.

The invention will now be described in detail with reference to specific preferred embodiments thereof, it being understood that these examples are intended to be illustrative only. The invention is not intended to be limited to the materials, conditions, or process parameters recited herein, it being noted that all parts and percentages are by weight unless otherwise indicated.

EXAMPLE I

To 1,750 grams of ¼ inch stainless steel balls present in a Union Process 01 attritor was added 25 grams of Elvax II 5720 resin obtained from E.I. DuPont. The attritor was heated to 115° C. under constant stirring after which 4 grams of Orasol cyan Blue 2GLN dye (available from Ciba-Geigy) dissolved in 40 milliliters of methanol were added slowly to the molten resin. Mixing of the dye solution with the resin was continued for about 1 hour after which time all of the methanol has evaporated leaving a molten dyed resin in the attritor. Two-hundred fifty (250) grams of hot Isopar® L (available from Exxon) was then added to the dyed resin, and attrition was continued for a further hour. The attritor was then cooled to 25° C. over a period of three hours.

The resulting dispersion had a solids content of 10.4 percent by weight with the average particle size diameter being 2.5 microns as measured using a Horiba Centrifugal Analyzer. The dispersion was then diluted to a particle concentration of 1.5 percent by weight by the addition of Isopar® L (available from Exxon).

To 100 grams of the above dispersion was added 1 milliliter of a solution of lecithin (50 milligrams) obtained from Fisher Scientific that was dissolved in Isopar® L. The resulting liquid developer was then allowed to equilibrate for 24 hours. Electrical measurements indicated that the developer was negatively charged with a charge/mass ratio of 100 $\mu C\ g^{-1}$. The ink was then placed in a Savin 870® copier and imaged, that is final images resulted subsequent to development with the aforementioned prepared ink composition. It was found that the transfer efficiency of the ink was 90 percent as measured gravimetrically while the optical density of the cyan colored solid area was found to be 1.0 as measured with a Macbeth TR927 densitometer, and the resolution was 8 line pairs/millimeter.

EXAMPLE II

The procedure described in Example I was repeated except that Orasol magenta Red G (available from Ciba-Geigy) was used in place of the Orasol Blue 2 GLN. The resulting liquid developer had a charge/mass ratio of 90 $\mu C\ g^{-1}$. The ink was then placed in a Savin 870® copier and imaged. The transfer efficiency of the ink was 88 percent as measured gravimetrically while the optical density of the magenta solid area was found to be 0.95 as measured with a Macbeth TR927 densitometer with a resolution of 8 line pairs/millimeter.

EXAMPLE III

The procedure described in Example I was repeated except that Orasol Yellow 2GLN (available from Ciba-Geigy) was used in place of Orasol Blue 2GLN. After electrostatic charging and equilibration, the ink had a charge/mass ratio of 100 $\mu C\ g^{-1}$. The ink was then placed in a Savin 870® copier and imaged. The transfer efficiency of the ink was 90 percent as measured gravimetrically while the optical density of the yellow solid area was 0.9 as measured with a Macbeth TR927 densitometer, and the resolution was 8 line pairs/millimeter.

EXAMPLE IV

The procedure described in Example I was repeated except that a mixture of 0.28 gram of Orasol Blue 2 GLN, 0.20 gram of Orasol Red G, 0.20 gram of Orasol Yellow 2GLN and 0.15 gram of Orasol Black RL were used in place of the Orasol Blue 2GLN. The resulting liquid developer had a charge/mass ratio of 110 $\mu C\ g^{-1}$. The negatively charged ink was then place in a Savin 870® copier and imaged. The transfer efficiency of the ink was 92 percent as measured gravimetrically while the optical density of the black solid area was 1.05 as measured with a Macbeth TR927 densitometer with a resolution (the black solid area) of 8 line pairs/millimeter.

EXAMPLE V

The procedure described in Example IV was repeated except that basic barium petronate (available from Witco Chemical Company) was used in place of lecithin as the charge control additive at the same concentration level. The resulting liquid developer was then allowed to equilibrate for 24 hours. Electrical measurements indicated that the developer was negatively charged with a measured charge/mass ratio of 110 $\mu C\ g^{-1}$. The ink was then placed in a Savin 870® copier and imaged. The transfer efficiency of the ink was 92 percent as measured gravimetrically while the optical density of the black solid area was 1.1 as measured with a Macbeth TR927 densitometer with a resolution of 8 line pairs/millimeter.

EXAMPLE VI

The procedure described in Example IV was repeated except that basic barium petronate (available from Witco Chemical Company) was used at the same concentration in place of lecithin. The resulting liquid developer had a measured charge/mass ratio of 100 $\mu C\ g^{-1}$. The ink was then placed in a Savin 870® copier and imaged. The transfer efficiency of the ink was 92 percent as measured gravimetrically while the optical density of the black solid area was found to be 1.1 as measured with a Macbeth TR927 densitometer with a resolution of 8 line pairs/millimeter.

EXAMPLE VII

The procedure described in Example IV was repeated except that 0.2 gram of OLOA1200 (available from Chevron Chemical Company) was used in place of lecithin. The resulting liquid developer was then allowed to equilibrate for 24 hours. Electrical measurements indicated that the particles were negatively charged with a charge/mass ratio of 90 $\mu C\ g^{-1}$. The ink was then placed in a Savin 870® copier and imaged. The transfer efficiency of the ink was 92 percent as measured gravimetrically while the optical density of the black solid area was found to be 1.0 as measured with a Macbeth TR927 densitometer. The black solid area had a resolution of 8 line pairs/millimeter.

EXAMPLE VIII

The procedure described in Example I was repeated except that 0.5 milliliter of a 12 weight percent solution of zirconium octoate from Nuodex was used in place of lecithin. The resulting ink was then allowed to equilibrate for 24 hours. Electrical measurements indicated that the particles were positively charged with a charge/mass ratio of 120 $\mu C\ g^{-1}$. The ink was then placed in a Savin 870® copier and imaged in a reversal development mode. The transfer efficiency of the ink was 92 percent as measured gravimetrically while the optical density of the solid area was 1.0 as measured with a Macbeth TR927 densitometer with a resolution of 8 line pairs/millimeter.

EXAMPLE IX

The procedure described in Example IV was repeated except that 0.5 milliliter of a 12 weight percent solution of zirconium octoate from Nuodex was used as the charge director in place of basic barium petronate. The resulting ink was then allowed to equilibrate for 24 hours. Electrical measurements indicated that the particles were positively charged with a charge/mass ratio of 110 $\mu C\ g^{-1}$. The ink was then placed in a Savin 870® copier and imaged in a reversal development mode. The transfer efficiency of the ink was 90 percent as measured gravimetrically while the optical density of the black solid area was found to be 1.0 as measured with a Macbeth TR927 densitometer with a resolution of 8 line pairs/millimeter.

Other modifications of the present invention may occur to those skilled in the art subsequent to a review of the present application. These modifications, including equivalents thereof are intended to be included within the scope of the present invention.

What is claimed is:

1. A liquid developer composition comprised of aliphatic hydrocarbon insoluble polyolefin resin particles, a hydrocarbon carrier liquid, dye or dyes which are soluble in the resin, and insoluble in the liquid, and a charge director, which composition is prepared by mixing the polyolefin resin particles with the dye or dyes to achieve solubilization thereof followed by heating whereby the resin melts and thereafter cooling.

2. A developer composition in accordance with claim 1 wherein the resin particles are selected from the group consisting of Elvax and mixtures thereof.

3. A developer composition in accordance with claim 1 wherein the dyes are selected from the group consisting of Orasol Red, Orasol Blue, Orasol Black, Orasol Yellow, Savinyl Yellow, Savinyl Pink, Savinyl Red, Savinyl Black, and Neozapon Black, and mixtures thereof.

4. A composition in accordance with claim 1 wherein the charge director is selected from the group consisting of zirconium octoate, iron naphthenate, and mixtures thereof enabling a positively charged developer.

5. A composition in accordance with claim 1 wherein the charge director is selected from the group consisting of lecithin, basic barium petronate and polyisobutylene succiminide enabling a negatively charged developer.

6. A composition in accordance with claim 1 wherein the charge director is present in an amount of from about 0.01 to about 2.0 weight percent.

7. A composition in accordance with claim 1 wherein the charge director is present in an amount of from about 0.02 to about 0.2 weight percent.

8. A composition in accordance with claim 1 wherein the resin particles are present in an amount of from about 90 to about 99 percent by weight.

9. A composition in accordance with claim 1 wherein the resin is a polymer comprised of polyethylene copolymerized with methacrylic acid.

10. A composition in accordance with claim 1 wherein the dye or dyes are molecularly dispersed in the resin.

11. A composition in accordance with claim 1 wherein the developer composition has an average particle diameter of from about 2 to about 6 microns.

12. A method of imaging which comprises generating an image in an electrophotographic imaging apparatus; subsequently developing this image with the composition of claim 1; thereafter transferring the image to a suitable substrate; and permanently affixing the image thereto.

13. A method of imaging in accordance with claim 12 wherein the developed image exhibited a transfer efficiency of from about 80 to about 99 percent from the substrate.

14. A method of imaging in accordance with claim 13 wherein the substrate is paper.

15. A composition in accordance with claim 1 wherein the developer is of an average particle diameter of from about 2 to about 3 microns.

16. A composition in accordance with claim 1 wherein the hydrocarbon carrier liquid is a petroleum distillate.

17. A composition in accordance with claim 1 wherein the hydrocarbon carrier liquid is an aliphatic component with from 1 to about 25 carbon atoms.

18. A developer composition in accordance with claim 1 wherein the hydrocarbon carrier liquid is an Isopar®.

19. A developer composition in accordance with claim 1 wherein the hydrocarbon carrier liquid has a viscosity of less than about 3 centipoise.

20. A developer composition in accordance with claim 1 wherein the hydrocarbon carrier liquid is selected from the group consisting of Norpar®, isoparaffinic hydrocarbons Soltrols®, Pagasols®, Shellsols®, and mixtures thereof.

21. A developer composition in accordance with claim 1 wherein the carrier liquid is Isopar® G, Isopar® H, Isopar® K, Isopar® L, Isopar® M, or mixtures thereof.

* * * * *